United States Patent [19]

Friberg et al.

[11] 4,006,997

[45] * Feb. 8, 1977

[54] SUPERSONIC CENTRIFUGAL COMPRESSORS

[75] Inventors: Jean Friberg, Bourg La Reine; Jean-Marie Merigoux, Palaiseau, both of France

[73] Assignee: Compagnie Industrielle des Telecommunications Cit-Alcatel, France

[ * ] Notice: The portion of the term of this patent subsequent to Nov. 13, 1990, has been disclaimed.

[22] Filed: Nov. 6, 1973

[21] Appl. No.: 413,224

[30] Foreign Application Priority Data

Nov. 6, 1972 France ..... 72.39210

[52] U.S. Cl. ..... 415/181; 415/213 R; 415/211

[51] Int. Cl.[2] ..... F04D 21/00

[58] Field of Search ..... 415/181, 213 R, 206, 415/219 C, 211

[56] References Cited

UNITED STATES PATENTS

| | | | |
|---|---|---|---|
| 2,434,018 | 1/1948 | Stepanoff | 415/213 R |
| 2,465,625 | 3/1949 | Aue | 415/213 R |
| 2,967,013 | 1/1961 | Dallenbach et al. | 415/181 |
| 3,460,748 | 8/1969 | Erwin | 415/181 |
| 3,771,925 | 11/1973 | Friberg et al. | 415/181 |

FOREIGN PATENTS OR APPLICATIONS

| | | | |
|---|---|---|---|
| 110,505 | 6/1964 | Czechoslovakia | 415/181 |
| 1,188,110 | 3/1959 | France | 415/181 |

*Primary Examiner*—Henry F. Raduazo
*Attorney, Agent, or Firm*—Craig & Antonelli

[57] ABSTRACT

Improvement to supersonic centrifugal compressors comprising a set of radial blades fixed to a mobile circular rim chocked on the compressor shaft and extending beyond the blades by a flat ring limiting, with a fixed upper housing, a semi-fixed, semi-mobile diffuser and in which the distance separating the axis of rotation of the machine from a trailing edge of the mobile blades is greater in the vicinity of the fixed housing than in the proximity of the mobile rim; the invention enables a good distribution of the flow speed of the fluid to be obtained at the output of mobile blades in the semi-fixed semi-mobile diffuser.

5 Claims, 9 Drawing Figures

SUPERSONIC CENTRIFUGAL COMPRESSORS

Figure 1C:
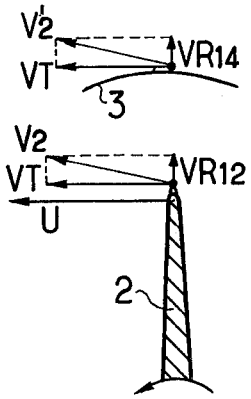

The present invention conerns an improvement to supersonic centrifugal compressors having a high compression ratio.

It is known that centrifugal compressors having a high compression ratio in which a part of the transformation of the kinetic energy in pressure is obtained using a rotor type diffuser formed by extending the radius of the flanges rotating beyond the blades.

The flow of the fluid between the walls moving at a speed close to that of the fluid enables a high output as long as the peripheral speed of the blades does not exceed 300 m/sec. When the peripheral rotation of the blades reach values of 400 to 500 m/sec., the centrifugal stresses assume high values leading to major deformations of the two flanges. The upper flange being drilled, in that type of compressor, with a large inlet opening for air or fluid to be compressed, whereas this is not the case with the lower flange (at high speeds very different centrifugal stresses appear in these flanges). In these conditions, if the blades are connected to the two rims, they have a tendency to undergo, while rotating, abnormal stresses which lead to the destruction of the rotor.

It is known that these imperfections have been overcome by means of an arrangement consisting in fixing the radial blades on the lower flange chocked on the drive shaft whereas a fixed upper housing limits successively with the mobile flange going from the center towards the periphery, an inlet flap and a space having the general shape of an incurvated truncated cone in which the mobile blades move, the lower circular mobile flange being extended radially beyond the outside end of the blades to form, with the extension of the fixed housing, a fluid slowing down space, whose two faces are substantially parallel.

Due to that slowing down ring, a fluid coming from the blades at speeds close to mach 1.2 to mach 1.3 reaches, on the peripheral edge of the rotor only a speed of slightly lower than mach 1.1. It is then possible to direct the fluid towards a fixed diffuser designed very simply as soon as the speed of the fluid at the input of the diffuser is only very slightly supersonic.

By reason of the deformities which both the blades and the flange undergo due to centrifugal stress, it is fairly difficult to leave between the mobile blade and the fixed housing only negligible play. Within the moving fluid, there hence appears, in the immediate vicinity of the part of the mobile blade close to the play, a certain decrease in the radial speed of the fluid. That slight alteration causes, in the fluid slowing down zone, an unfavorable distribution of the speeds in the output edge of the mobile diffuser both in direction and in module, at least in the part of the fluid nearer to the housing than to the mobile flange.

The aim followed in the present invention is precisely to correct this unbalance in the distribution of the speeds by making in compressors having only one mobile flange simple modifications in structure.

Figure 1A:
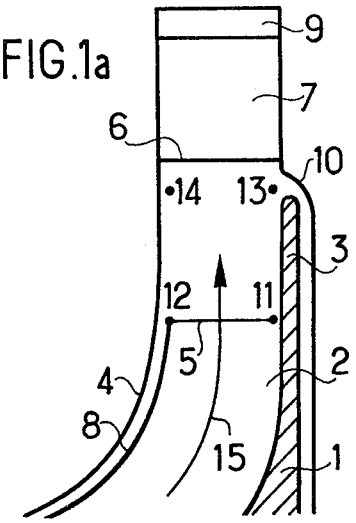
Figure 1B:
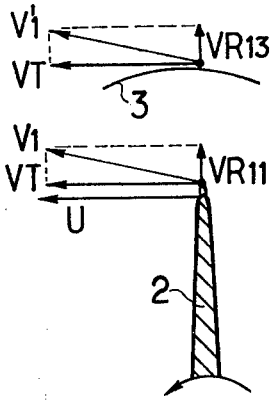
Figure 2C:
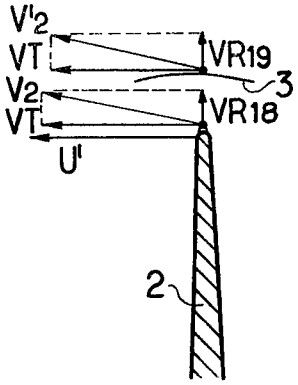
Figure 2A:
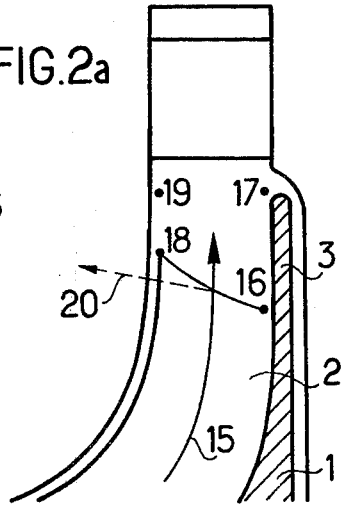
Figure 2B:
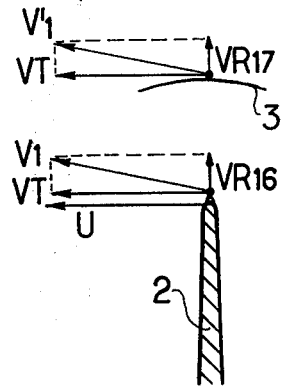
Figure 3:
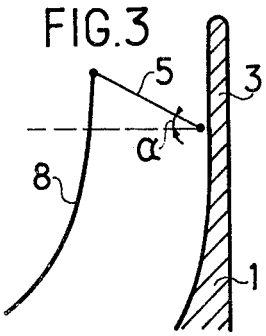

The object of the invention and the examples of embodiment are described herebelow with reference to the three accompanying drawings, in which:

FIGS. 1*a*, 1*b*, and 1*c* illustrate the diagram of the composition of the speeds at the output of a rotor type diffuser having only one veil, known to the man in the art;

FIGS. 2*a*, 2*b*, and 2*c* enable the diagram of the composition of the speeds to be determined in the case of an example of embodiment according to the invention;

FIG. 3 shows another example of embodiment according to the invention.

Figure 4:
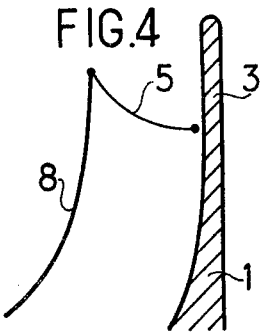
Figure 5:
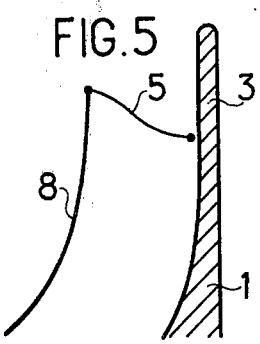

FIGS. 4 and 5, respectively, illustrate further examples according to the present invention.

FIG. 1*a* shows an axial cutaway view of a supersonic centrifugal compressor known to the man in the art, comprising only one mobile veil 1, bearing the mobile blades 2 and extended beyond the said mobile blades by a plane circular ring 3. The fluid duct is limited on the one hand by the said mobile veil and on the other hand by the fixed housing 4 which, itself too, is extended beyond the mobile blades to define with the extension 3 of the mobile veil 1 a decleration zone limited upstream by the trailing edge 5 of the mobile blade 2 and downstream by the ridge 6 of the fixed diffuser 7. The housing is extended at 9 and 10.

As has been specified above, the edge 8 of the mobile blade 2 determines, with the portion 4 of the housing facing it, a certain play tending to produce a return current towards the upstream of the fluid accelerated by the rotation of the blade. The result of this is that the speeds measured at points such as 11 and 13 are different from the speeds measured at 12 and 14 as will be seen from the diagrams in FIGS. 1*b* and 1*c*.

FIG. 1b shows a cutaway view of the mobile veil 3 in a plane perpendicular to the axis of rotation so that the mobile blade 2 appears in a cutaway view. At 11, the tangential speed VT of the fluid is close to the drive speed U of the mobile veil rotating. The coefficient of slippage $$g = VT/U$$

is close to the unit $g \simeq 0.95$ for example.

The radial speed has a value Vr. The resulting speed is therefore the vector V1.

At a point situated at the end of the mobile veil, such as 13, the tangential speed has decreased according to the law $$R \times VT = \text{constant}$$

R being the distance from the point considered to the axis of rotation of the machine.

As the radius R has increased, VT is smaller in the same proportion; moreover, the radial speed of the fluid has slightly decreased.

The resulting speed V'1 is substantially parallel to V1 and slightly smaller in modulus.

At the other end of the blade (FIG. 1*c*) at the point 12, the tangential speed VT is slighter because of a slippage in the order of $$g = 0.85$$

Likewise, the radial speed is decreased in appreciable proportions because of the return current which is produced subsequent to the play which exists between the edge 8 of the blade and the portion 4 of the housing. The return current depends essentially on that play.

At the point 14, which is similar to the point 13, the tangential speed has slowed down in relation to the tangential speed at the point 12 on the one hand because of the relation, $$VT \times R = \text{constant}$$

and on the other hand because of the friction of the fluid against the fixed wall, the radial speed Vr is also reduced because of the friction of the fluid.

At the point 14, the vector V'2 is therefore smaller than the speed vector V2 obtained at 12. It is different from the speeds V1 and V'1 obtained respectively at the points 11 and 13.

To sum up, the speed decreases substantially when moving along a direction perpendicular to the flow of the fluid. (Going, for example, from the mobile veil to the fixed housing.)

This dissymmetry in the flow gives rise to problems at the output of the rotor at the instant when the fluid comes up against the diffuser.

Among the various possible solutions for compensating this dissymmetry, the inventors have noted that the simplest solution leads to the result affording the most advantages.

The object of the invention is therefore an improvement to supersonic centrifugal compressors having a high compression ratio using a set of radial blades fixed on a circular mobile flange chocked on the drive shaft of the said compressor extended beyond the blades by a flat ring limiting with the upper housing a fluid slowing down space, characterized in that the distance separating the axis of rotation of the machine from the trailing edge of the mobile blades is greater in the vicinity of the fixed housing than in the proximity of the mobile flange.

Whereas as a general rule, manufacturers provide for the limiting of the mobile blade by giving the trailing edge a direction substantially perpendicular to the lines of current 15 (FIG. 1*a*), the inventors impart to the trailing edge a shape such that its end situated in the vicinity of the fixed housing be downstream from the normal, at the meeting point of the trailing edge with the center line of the fluid flow, at that flow center line.

On referring to FIG. 2*a*, it will be seen that the drive speed at the point 18 will be higher than at the point 16. It will be also be seen that the end 18 of the trailing edge is situated downstream from the normal position 20 at the center line of the current 15.

The result of this is that at the points 16 and 17, the diagram of the speeds remains unchanged and the diagram in FIG. 2*b* is identical to the diagram of the speeds in FIG. 1*b*.

On the other hand, the drive speed U' at the point 18 (FIG. 2*c*) will be chosen so as to compensate the unfavorable slippage which occurs at that end of the blade. Hence, a higher tangential speed, VT than previously will be obtained. Now, the energy imparted to the fluid being in the order of $gU^2$, the decrease of $g$ is compensated by an increase in U.

Moreover, when passing from the point 18 to the point 19, the variation in the radius being smaller than previously, the tangential speed and the radial speed remain nearer at 19 to the value obtained at 18. The result of this is a much less marked difference between the speed V'1, at the point 17 and the speed V'2 at the point 19. The flow of the fluid becomes very clearly more favorable and the improvement in the output is spectacular.

For reasons of simplicity in construction, it is often an advantage to impart to the trailing edge a very substantially rectilinear aspect, inclined by an angle in relation to the normal to the direction of the flow of the fluid, as shown in FIG. 3 consisting substantially in giving the tangential speed of the trailing edge a constant value by linear increase of the drive speed.

In certain cases, according to the nature of the fixed diffuser placed downstream from the rotor, it is sometimes an advantage to impart to the trailing edge a curved incurvated aspect having a concavity turned outwards, making the drive speed of the fluid at the trailing edge increase in a non-linear way so as to compensate the losses by friction on contact with the fixed housing better and to impart mainly to the fluid streams close to the play between the wheel and the fixed housing a greater energy, as shown in FIG. 4. It may also be an advantage to round off the end of the trailing edge in the vicinity of the housing as shown in FIG. 5.

Although the devices which have just been described may appear to afford the greatest advantages in a given technical situation, it will be understood that various modifications may be made thereto without going beyond the scope of the invention by replacing certain components by other components capable of fulfilling the same technical function.

What is claimed is:

1. In a supersonic centrifugal compressor for handling fluids at supersonic speed including a drive shaft, a circular mobile flange chocked on said drive shaft and extending radially outwardly, a set of radial blades fixed on said mobile flange along one longitudinal edge thereof in circumferentially spaced relationship and having free edges spaced from said mobile flange, a housing disposed about said flange and said blades in proximity thereto, and a flat ring provided as an extension of said mobile flange beyond said blades defining with said housing a fluid slowing down space, the improvement being comprised in providing the radially outward edge of said radial blades with a configuration such that the distance between the axis of said drive shaft and said radially outward edge of the radial blades is greater in the vicinity of said housing than it is in the vicinity of said mobile flange.

2. A supersonic centrifugal compressor as defined in claim 1 wherein the radially outward edge of each blade has a rectilinear configuration.

3. A supersonic centrifugal compressor as defined in claim 1 wherein the radially outward edge of each blade has a curved shape with a radially outwardly directed concavity.

4. A supersonic centrifugal compressor as defined in claim 1 wherein the radially outward edge of each blade has an S-shaped configuration.

5. A supersonic centrifugal compressor as defined in claim 1, wherein a diffuser is provided with vanes beyond said fluid slowing down space from said blades.

* * * * *

Disclaimer and Dedication 4,006,997.—*Jean Friberg*, Bourg La Reine and *Jean-Marie Merigoux*, Palaiseau, France. SUPERSONIC CENTRIFUGAL COMPRESSORS. Patent dated Feb. 8, 1977. Disclaimer and Dedication filed July 17, 1980, by the assignee, *Compagnie Industrielle des Telecommunications Cit-Alcatel.*

Hereby disclaims and dedicates said patent to the Public.

[*Official Gazette September 9, 1980.*]